US010130865B2

(12) United States Patent
Paulson et al.

(10) Patent No.: US 10,130,865 B2
(45) Date of Patent: Nov. 20, 2018

(54) MICRO ADJUSTMENT MECHANISM FOR A PITCHING MACHINE

(71) Applicant: JUGS SPORTS, INC., Tualatin, OR (US)

(72) Inventors: Kerry K. Paulson, Turner, OR (US); Gregory Jack Anderson, Sherwood, OR (US); Terry Kenneth Dewar, Clackamas, OR (US); Jason Robert Weddle, Portland, OR (US)

(73) Assignee: JUGS SPORTS, INC., Tualatin, OR (US)

( * ) Notice: Subject to any disclaimer, the term of this patent is extended or adjusted under 35 U.S.C. 154(b) by 0 days.

(21) Appl. No.: 15/471,803

(22) Filed: Mar. 28, 2017

(65) Prior Publication Data

US 2018/0280779 A1 Oct. 4, 2018

(51) Int. Cl.
*A63B 69/40* (2006.01)
*F41B 4/00* (2006.01)

(52) U.S. Cl.
CPC ..... *A63B 69/406* (2013.01); *F41B 4/00* (2013.01)

(58) Field of Classification Search
CPC ... F41B 4/00; A63B 69/406; A63B 2069/402; A63B 2225/09
USPC ..... 124/78
See application file for complete search history.

(56) References Cited

U.S. PATENT DOCUMENTS 3,774,584 A * 11/1973 Paulson ..... A63B 69/406 124/78
3,811,421 A * 5/1974 Betten ..... A63B 69/406 124/78
4,323,048 A * 4/1982 Saito ..... A63B 69/406 124/78
4,922,885 A * 5/1990 Iwabuchi ..... A63B 69/406 124/78
5,437,261 A * 8/1995 Paulson ..... A63B 69/406 124/1
6,732,724 B1 * 5/2004 Paulson ..... A63B 69/406 124/6
6,863,059 B1 * 3/2005 Lee ..... F41B 4/00 124/6

(Continued)

OTHER PUBLICATIONS

"Hack Attack Baseball Pitching Machine"; Professional Sports Training Equipment—Sports Attack LLC; retrieved from the Internet on Apr. 11, 2017 at <http://www.sportsattack.com/store/hack-attack-baseball-pitching-machine/>; 1 page.

(Continued)

*Primary Examiner* — Alexander Niconovich
(74) *Attorney, Agent, or Firm* — Schwabe Williamson & Wyatt, PC

(57) ABSTRACT

A machine for throwing balls is provided that can accurately adjust the vertical height or pitch and the lateral placement or yaw of balls being thrown. The machine includes a pitch housing, a threaded pitch adjustment shaft rotatably mounted to the pitch housing, a pitch yoke threadably mounted to the pitch adjustment shaft, a yaw housing to which the pitch housing is fixed, and a threaded yaw adjustment shaft rotatably mounted to the yaw housing. Also included is a yaw yoke mounted to the yaw housing and to the yaw adjustment shaft, and a stand to which the yaw housing is rotatably mounted.

12 Claims, 7 Drawing Sheets

(56) References Cited

U.S. PATENT DOCUMENTS

| | | | | |
|---|---|---|---|---|
| 7,040,309 | B2 * | 5/2006 | Johndreau | A63B 69/406 124/78 |
| 8,001,954 | B2 * | 8/2011 | Boehner | A63B 69/406 124/78 |
| 8,133,137 | B2 * | 3/2012 | Grant | A63B 69/406 473/451 |
| 8,932,156 | B2 * | 1/2015 | Boehner | A63B 69/406 124/78 |
| 9,050,520 | B2 * | 6/2015 | Lu | A63B 69/406 |
| 9,180,355 | B1 * | 11/2015 | Boehner | F41B 4/00 |
| 9,579,554 | B1 * | 2/2017 | Madden | A63B 69/408 |
| 2009/0260611 | A1 * | 10/2009 | Grant | A63B 69/406 124/78 |
| 2012/0097145 | A1 * | 4/2012 | Lu | A63B 69/406 124/78 |

OTHER PUBLICATIONS

"M3 Baseball Pitching Machine"; ATEC; retrieved from the internet on Apr. 11, 2017 at <http://www.atecsports.com/machines/baseball/m3-baseball-pitching-machine>; 3 pages.

"Triple Play Pro Pitching Machine"; Sports Machines America Inc.; retrieved from the Internet on Apr. 11, 2017 at <http://www.sportsmachines.info/triple-play-pro-pitching-machine.php>; 3 pages.

"Spin Ball Pro 3 Wheel Baseball Pitching Machine"; Rawlings; retrieved from the internet on Apr. 11, 2017 at <https://www.rawlings.com/product/RPM3BB.html?cgid=gear-training>; 3 pages.

"The Ultimate Pitching Machine—Replacement Parts for the Ultimate Pitching Machines"; retrieved from the internet on Apr. 11, 2017 at <http://www.ultimatepitchingmachine.com/x/home.php?cat=2&sort=orderby&sort_direction=0&page=2>; 9 pages.

* cited by examiner

MICRO ADJUSTMENT MECHANISM FOR A PITCHING MACHINE

FIELD OF THE INVENTION

The invention relates to an adjustment mechanism for a pitching or throwing machine.

BACKGROUND

Pitching and throwing machines have been used for many years. They have proven very effective in permitting baseball and softball batters, football receivers, soccer goalies, lacrosse, cricket players and others to practice hitting and catching thrown balls. They are also used in game situations where players run a risk of throwing out their arms or the players are simply too young and uncoordinated to reliably pitch strikes that batters can hit. In certain sports, such as football, it is often not critical that the ball be throwing perfectly, as the receivers need to learn to catch balls that are not thrown perfectly at them. In other sports, however, such as baseball, it may be important to precisely locate pitched balls so that batters can learn to hit balls that are just inside the strike zone or learn to take balls that are just outside of the strike zone. Or, if used in an actual game, can make it more challenging for the batter as the position of the pitch is even slightly changed. Similar advantages can be appreciated in other sports as well. Soccer goalies also need to be able to catch or at least block balls that are kicked into the corners of the net. Many pitching and throwing machines that have been manufactured and sold to date are simply not accurate enough to precisely locate the balls being thrown.

DETAILED DESCRIPTION OF THE PREFERRED EMBODIMENT

Figure 1:
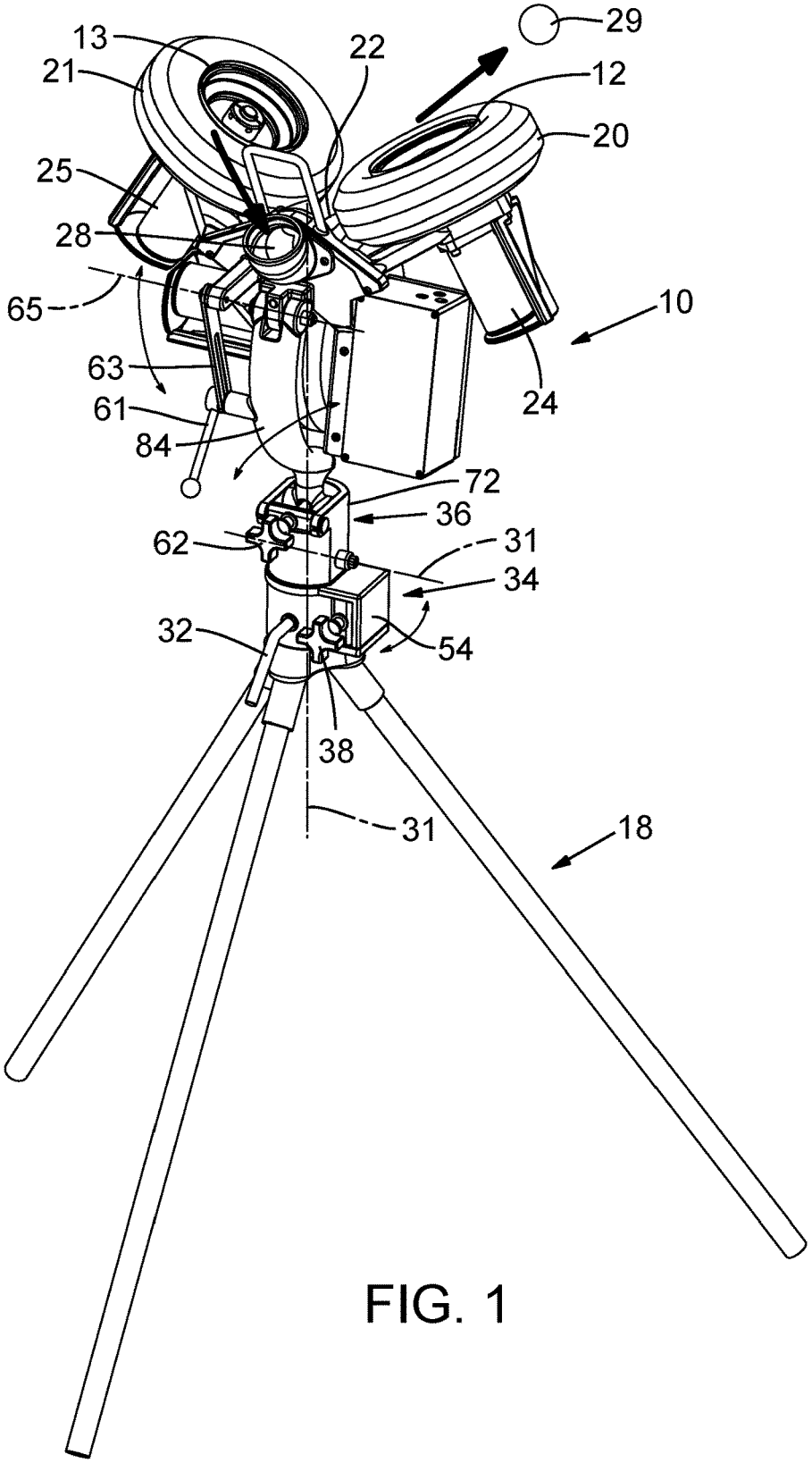
FIG. 1 is a perspective view of a ball throwing machine that incorporates a first embodiment of the disclosed micro adjustment mechanism.
Figure 2:
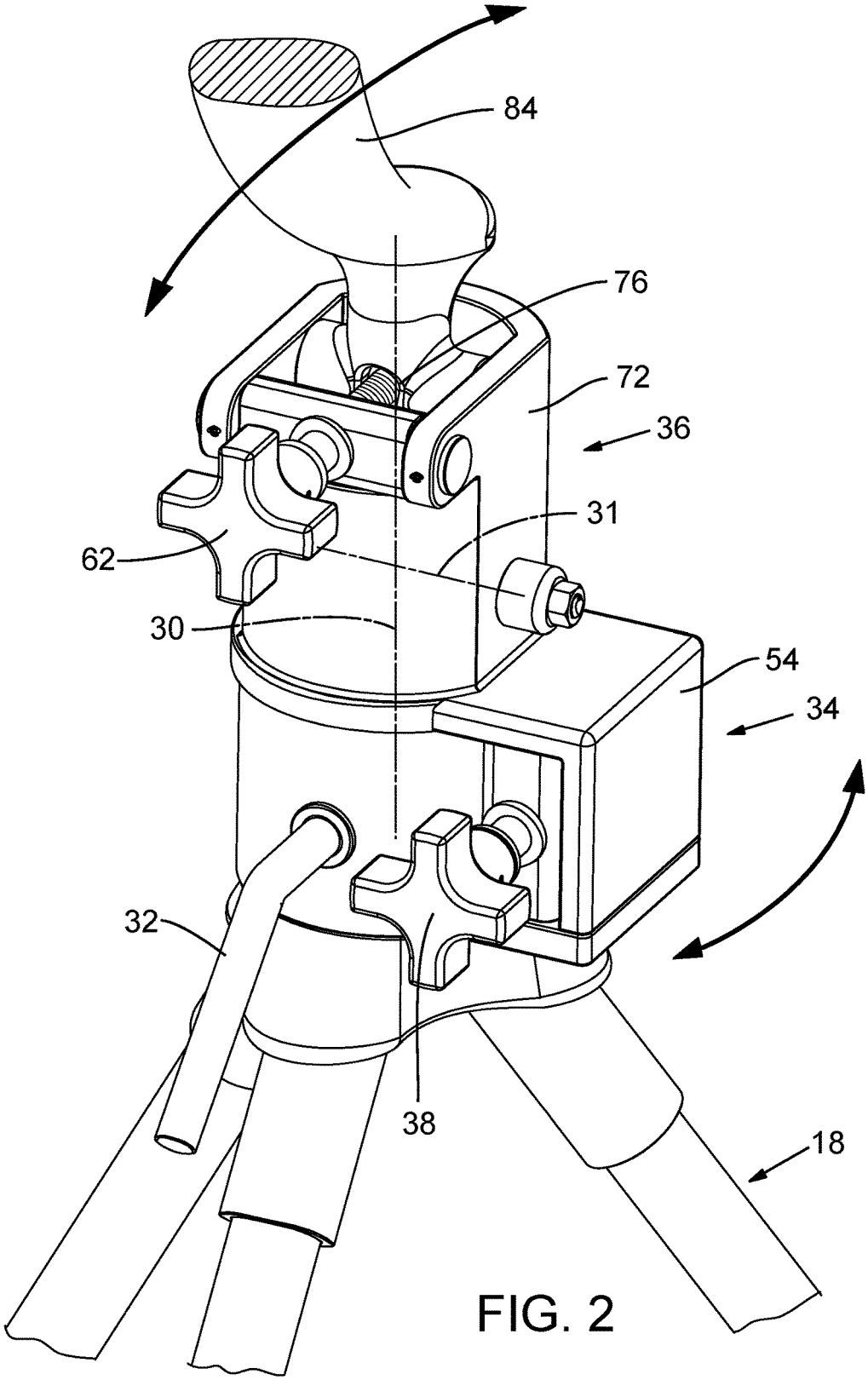
FIG. 2 is a perspective view of the embodiment of FIG. 1 showing only the micro adjustment mechanism.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments. The term "mounted" is used in the broadest sense to cover both a direct and indirect mounting. The term "forward" will refer to the side of the machine that would, in use, face the athlete when the machine is being used. The term "rearward" would be the opposite side, typically facing the operator.

One aspect of the depicted embodiment includes a machine for throwing balls, having a pitch housing, a rotatable threaded pitch adjustment shaft rotatably mounted to the pitch housing, a pitch yoke threadably mounted to the pitch adjustment shaft to travel with respect to the pitch adjustment shaft as the pitch adjustment shaft is rotated, a pitch pivot arm having proximal and central portions, the proximal portion of the pitch pivot arm being pivotally mounted at a pivot point, the pitch yoke being mounted to the central portion of the pitch pivot arm, at least one rotary wheel mounted to the pitch pivot arm such that the pitch yoke is mounted to the pitch pivot arm between the pivot point and the rotary wheel mounting, and at least one motor coupled to the at least one rotary wheel and configured to rotate the at least one rotary wheel to throw the ball toward an athlete. In this aspect of the disclosure, the pitch adjustment shaft may include two sets of oppositely-directed threads, with a first set of threads that threadably mount the pitch adjustment shaft to the pitch housing and a second set of threads to which the pitch yoke is threadably mounted. Or, in place of the second set of threads, the pitch adjustment shaft may be axially fixed with respect to the pitch housing.

Another aspect of the disclosure adds to the foregoing: a body to which the pitch adjustment housing is rotatably mounted; a rotatable threaded yaw adjustment shaft; a yaw yoke threadably mounted to the yaw adjustment shaft to travel with respect to the yaw adjustment shaft as the yaw adjustment shaft is rotated, the yaw yoke further being mounted to the body; and a yaw housing rotatably mounted to the body and to which the yaw adjustment shaft is rotatably mounted, such that as the yaw adjustment shaft is rotated, the yaw housing rotates with respect to the body to adjust throws slightly to the left or to the right. In this aspect of the disclosure, the yoke adjustment shaft includes two sets of oppositely-directed threads, with a first set of threads that threadably mount the yaw adjustment shaft to the yaw housing and a second set of threads to which the yaw yoke is threadably mounted. Or, in place of the second set of threads, the yaw adjustment shaft may be axially fixed with respect to the yaw housing.

Another aspect of the disclosure provides a machine for throwing balls that includes a body, a stand to which the body is mounted, a yaw housing rotatably mounted to the body, a yaw adjustment shaft rotatably mounted to the yaw housing, a yaw yoke threadably mounted to the yaw adjustment shaft to travel with respect to the yaw adjustment shaft as it is rotated, the yaw yoke being mounted to the body, so that by rotating the yaw adjustment shaft, the yaw adjustment yoke causes the yaw housing to rotate one direction or the other with respect to the body.

Yet another aspect of the disclosure provides a method of precisely adjusting, along a first plane, the throw by a throwing machine, including the steps of rotatably mounting a threaded first micro adjustment shaft to a first yoke so that the first yoke travels along the first micro adjustment shaft as the first micro adjustment shaft is turned, the first yoke being mounted to a first movable member, to which a throwing wheel is indirectly mounted, and rotating the first micro adjustment shaft, causing the first yoke to travel and thereby adjust the position of the throwing wheel along the first plane. Added to the foregoing method may be a method for precisely adjusting, along a second plane, the throw by a throwing machine, the second plane being offset 90 degrees from the first plane. This method may include: rotatably mounting a threaded second micro adjustment shaft to a second yoke so that the second yoke travels along the second micro adjustment shaft as the second micro adjustment shaft is turned, the second yoke being mounted to a second movable member, to which a throwing wheel is indirectly mounted; and rotating the second micro adjustment shaft, causing the second yoke to travel and thereby adjust the position of the throwing wheel along the second plane.

Referring to FIGS. 1-6, a ball throwing machine 10 may include one, two or three rotary wheels. The depicted embodiment 10 includes three such wheels 12, 13 and 14 that are coupled to a body portion 16 (see FIGS. 3 and 5) and supported on the ground by a support structure (e.g., a tripod) 18. In some embodiments, rotary wheels 12, 13 and 14 may include pneumatic tires 20, 21 and 22. A single motor 24 or multiple motors 24, 25 and 26 may be coupled to rotary wheels 12, 13 and 14, respectively, and be configured to rotationally drive the rotary wheels. The ball throwing machine 10 may further include a feed structure 28 configured to receive one or more balls 29 and serially bring the balls into contact with an outer circumferential surface of tires 20, 21 and 22. Feed structure 28 may be configured for hand-feeding of balls by an operator, and/or may be configured to automatically feed balls periodically to tires 20, 21 and 22.

Throwing machine 10 may also include a control panel (not shown), which permits the operator to control the speed and type of pitch or throw. Several options might include fast balls (at various speeds), change ups (again, at various speeds), curves (right hand or left hand), sliders, split fingered fastballs, etc. Similar options may be provided for non-baseball throwing machines like football or soccer ball-throwing machines. The control panel may also permit the operator to control the rate at which balls are thrown; that is, how often they are directed at the batter, goalie, receiver, etc.

As shown best in FIG. 3, throwing machine 10 may also include a locking arm 32 that extends through a yaw housing 54 and contacts body portion 16 to permit the position of the machine to be locked in position once the horizontal or yaw adjustment is first roughly located, and then precisely located by the yaw micro adjust mechanism to be described below. The remaining portion of this discussion will talk about the micro adjustment mechanism in the context of baseball pitching machines, but it should be understood that the mechanism and the throwing machine in which it is incorporated can be used in a wide variety of pitching or throwing machines as described earlier, and this disclosure and the claims herein should be considered broad enough to incorporate such machines.

The micro adjustment mechanism may include either horizontal or vertical adjustment features to adjust the yaw and pitch of the machine, respectively, but normally the machine has the capability to adjust both yaw and pitch. That is, the mechanism may have the ability to adjust the thrown balls in a first plane, but may also have the ability to adjust the thrown balls in a second plane that is disposed at 90 degrees to the first plane. In the figures, the horizontal (yaw) and vertical (pitch) adjustment mechanisms are indicated generally at 34 and 36, respectively. The construction and operation of the two mechanisms may be similar, but is typically not the same.

The yaw or horizontal adjustment mechanism 34 is designed to adjust the pitches laterally around a vertical axis 30 to permit the operator to pitch balls so they are just over the outside corner or slightly outside of the plate, or just over the inside corner or slightly inside of the plate, and everything in between. As noted above, the rough positions of the pitches are located by using locking arm 32 to rotate yaw housing 54. Similarly, the pitch or vertical adjustment 36 operates to control pitches between just within the vertical strike zone or just above or below of the strike zone, and positions in between. The rough vertical or pitch position of machine 10 is initially set using a rough control lever 61 (see FIG. 1), as will be described below.

The yaw or horizontal micro adjustment mechanism 34 will first be described. Machine 10 may include a yaw micro adjustment knob 38 disposed at a proximal end of a yaw micro adjustment control shaft 40, which typically includes threads 42 and 43 on at least portions of its length. A spring 44 (see FIGS. 4-6) to bias knob 38 and shaft 40 outwardly may also be included. Threads 42 and 43 may be opposite of each other, with one being right hand threaded and the other being left hand threaded. Since threads 42 and 43 are fine in nature and allow for smoother and finer adjustment, utilizing reversed or left and right threads on the shaft will typically reduce the adjustment time and turns versus a single thread design. For example, while thread 42 pushes through bracket 46, thread 43 pulls through yaw yoke 56 simultaneously.

A yaw micro adjustment shaft mounting post 46 is typically mounted by a pair of pins 48 that may extend vertically along vertical axis 49 between a lower frame plate and an upper frame plate, 50 and 52, respectively. Mounting post 46 threadably engages threads 42 in yaw micro adjust shaft 40. A yaw housing 54 is disposed between frame plates 50 and 52, and surrounds yaw adjustment mechanism 34 to protect it from dirt and debris and from probing fingers, which might otherwise get tangled up in the mechanism. Yaw housing 54 may also include an annular portion that extends around and is rotatably mounted with respect to body 16. Yaw housing 54 also includes an annular portion that may surround and be rotatably mounted with respect to body 16.

A yaw yoke 56 is threadably mounted with complementing threads to yaw micro adjust shaft 40 by a yaw yoke mounting pin 58, which extends through the shaft and engages the yaw yoke. Yaw yoke mounting pin 58 is typically rotatably received in the yaw yoke 56 because the yaw yoke is sometimes fixedly mounted, and in any event is mounted, to body 16, which, as seen in FIG. 3, is rotated by the yaw yoke as yaw adjustment shaft 40 is rotated. It will be noted that yaw housing 54 and a pitch housing 72 may be fixedly mounted to each other or be a single piece as depicted.

Figure 4:
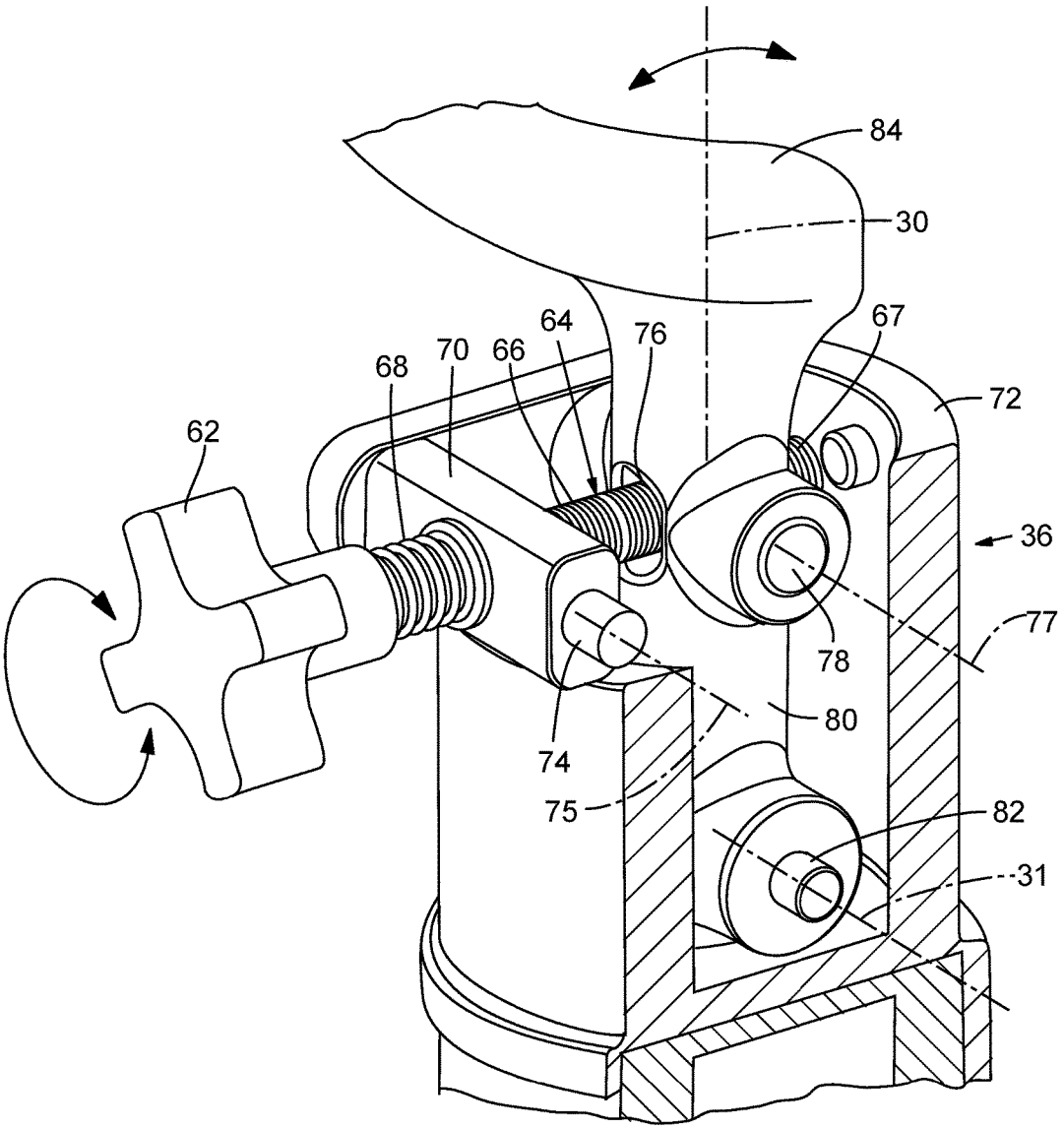
FIG. 4 is a perspective view corresponding to FIG. 3 except that only the pitch adjustment mechanism is shown, with the cover again removed to better show the workings of the adjustment mechanism.
Figure 5:
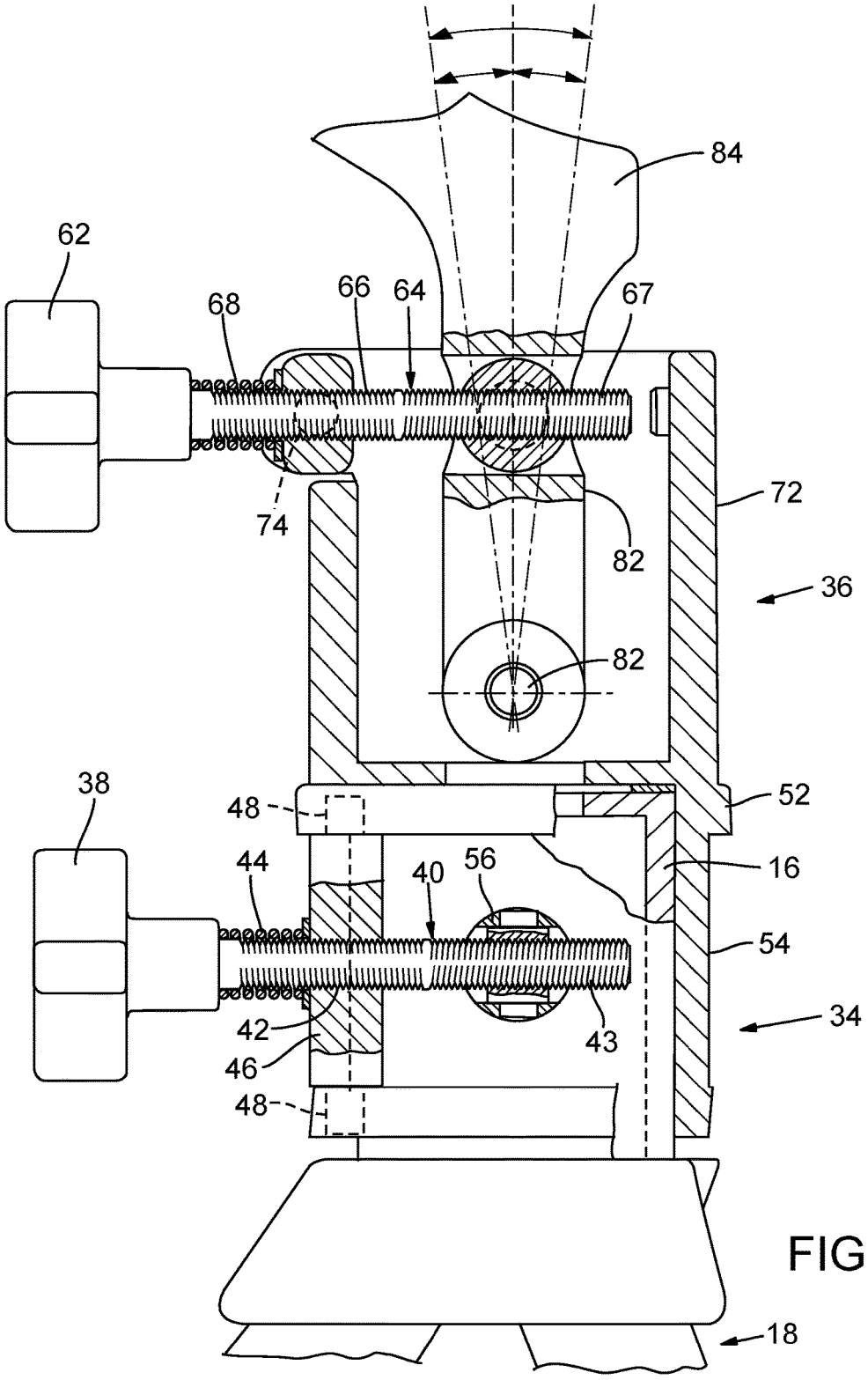
FIG. 5 is a side elevation sectional view of the first embodiment of the micro adjustment mechanism showing the lines corresponding to how the centerline of the pitch mechanism can be adjusted.
Figure 6:
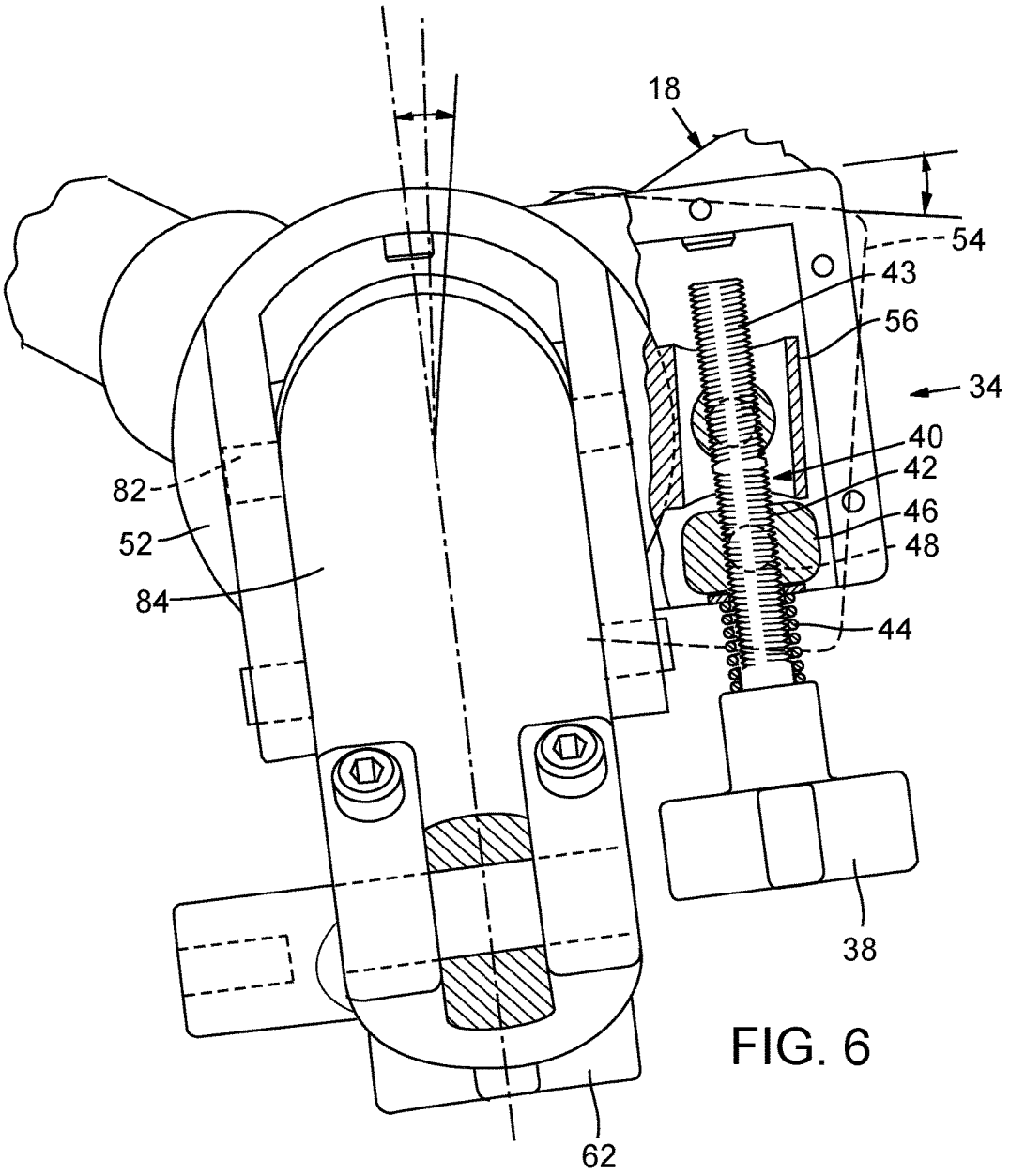
FIG. 6 is a top plan, partially sectioned view showing how the yaw adjustment mechanism is adjusted, again showing, in phantom, various positions the mechanism may take.

The operation of the yaw micro adjustment 34 will now be described. In order to roughly position the yaw of the machine, locking arm 32 is loosened and annular yaw housing 54 is rotated with respect to tripod 18. Then, to precisely position the machine, yaw micro adjust knob 38 is rotated, and yaw micro adjust shaft 40 moves into or out of mounting post 46 and yaw housing 54. The threaded engagement between yaw yoke 56 and yaw micro adjust control shaft 40 is held stationary by body portion 16, to which it is typically fixed, so rotation of the shaft causes yaw micro adjust shaft mounting post 46 to rotate in one direction or the other, carrying with it, yaw housing 54. Because yaw housing 54 is normally fixed to the upper portion of the machine or is a single integral part of the upper portion as shown in FIGS. 4 and 5, this rotation also rotates the pitch micro adjustment mechanism 36. Once the yaw position has been adjusted, locking arm 32 is tightened against body 16 to lock the yaw position of the machine.

The utilization of yaw micro adjustment mechanism 34 causes the initial position of the pitched ball to move very slightly from left to right or right to left, depending on the direction of rotation of micro adjust shaft 40, to permit the operator to hit or just miss the corners of the plate. This enables the batter to train to hit balls on the corners and to either take or hit balls that are slightly inside or outside of the plate. An example of the machine being rotated to the right is shown in phantom in FIG. 6. The depicted pivoting is approximately 7 degrees but the maximum pivoting through the yaw micro adjustment 34 might be more or less than that. And, of course, the micro adjust typically will rotate to a similar extent in the opposite or left direction.

The vertical or pitch micro adjustment mechanism 36 will now be described. As noted previously, this mechanism may be designed to operate in fashion similar to that of the yaw micro adjust, but it will typically not be the same. To roughly position the vertical or pitch angle, a rough control lever 61 is used to loosen the lever's engagement of a slotted link 63 that permits the upper portion of the machine 10 to be pivoted or rotated along a horizontal axis 65. Once the elevation of the machine is roughly set, control lever 61 is tightened and a pitch micro adjustment knob 62 disposed at a proximal end of a pitch micro adjustment control shaft 64 can be used to precisely position the vertical position or pitch of the machine.

As with the yaw micro adjustment control shaft 40, pitch micro adjustment shaft 64 may include two portions of threads, 66 and 67, one of which is typically right hand threaded and the other of which is typically left hand threaded. A spring 68 to bias shaft 64 outwardly may also be included. A pitch micro adjust shaft mounting post 70 may extend between the sides of a pitch housing 72 by a pair of mounting pins 74 that are mounted along a horizontal axis 75. Pitch micro adjust shaft mounting post 72 is typically designed to threadably receive pitch micro adjustment control shaft 64

Figure 3:
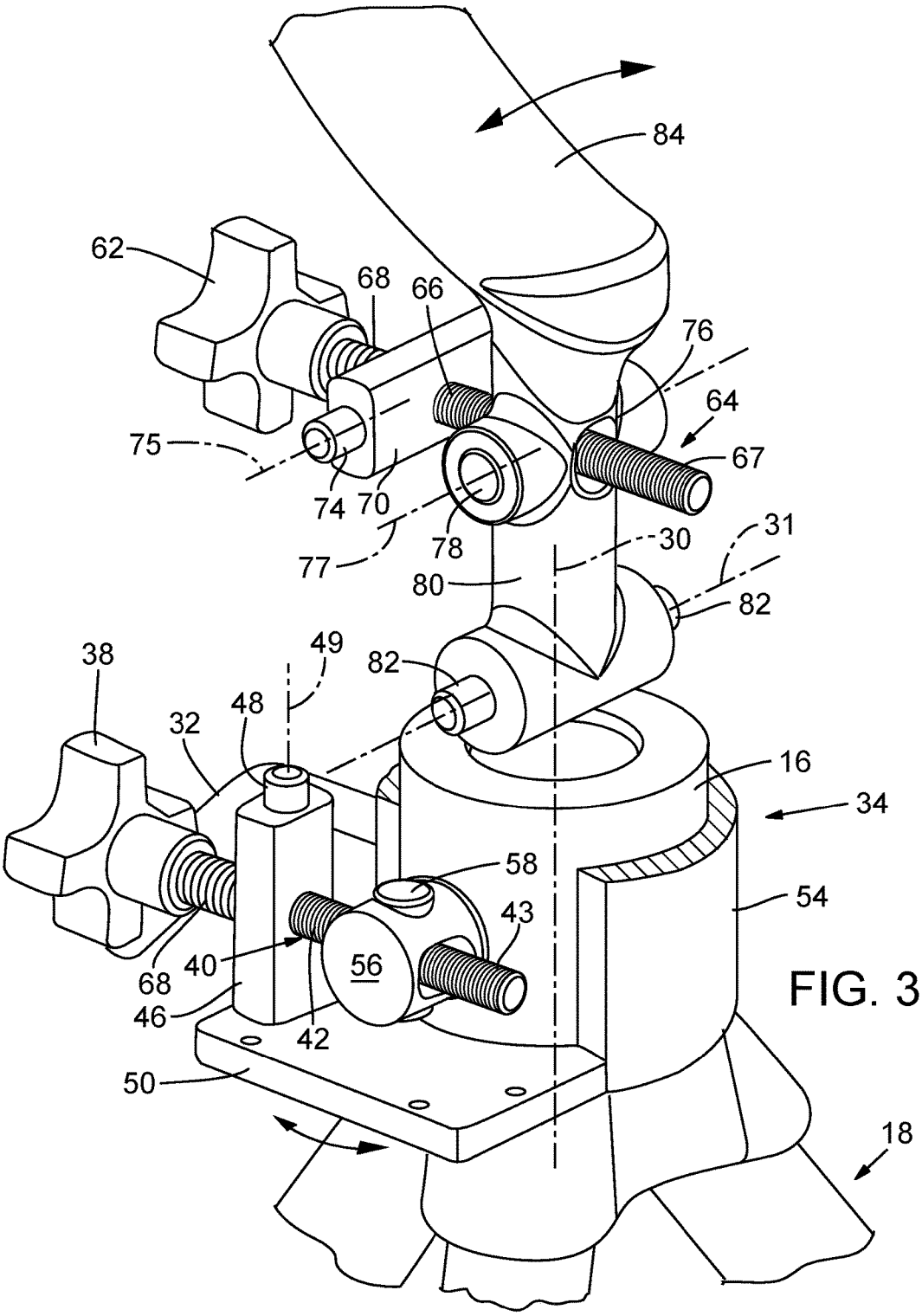
FIG. 3 is a perspective view of the embodiment of FIG. 1 with portions that cover the micro adjustment removed to better show the workings of the adjustment mechanism.

As best seen in FIGS. 3-5, a pitch yoke 76 disposed along axis 77 may be threadably mounted to pitch micro adjust shaft 64 by a pitch yoke mounting pin 78, which extends through pitch micro adjust control shaft 64 and may be rotatably received in the yoke. This rotatable mounting between pitch yoke 76 and its mounting pin 78 may be provided because the pitch yoke is typically mounted to a pitch pivot arm 80, and there typically is relative rotation occurring with respect to these components. Pitch pivot arm 80 includes one portion, that may be a proximal end, that is mounted to a pitch pivot pin 82 and another portion, that may be a distal end, that is mounted to a gooseneck 84, to which wheels 12, 13 and 14 may be mounted. Pitch pivot pin 82 may be pivotally mounted between the walls of a pitch housing 72 to pivot on horizontal axis 31. In the depicted embodiment, pitch yoke 76 is thus mounted to pitch pivot arm 80 between pitch pivot pin 82 and gooseneck 84.

Thus, as pitch micro adjustment knob 62 is rotated in a clockwise or counterclockwise fashion, the threads 66 on pitch micro adjust shaft 64 that are threadably received in pitch mounting post 70 cause the shaft to move forward or rearward within pitch housing 74. The threaded mounting between pitch yoke 76 and pitch micro adjust shaft 64 and yoke mounting pin 78 cause pitch pivot arm 80 to move to the left or the right in FIG. 5, causing the pitch pivot arm to pivot in pitch pivot pin 82. This causes gooseneck 84 to tilt slightly upwardly or downwardly. This, in turn, slightly adjusts the height of the pitches, enabling the batter to train to hit balls at the high and low periphery of the strike zone and to either take or hit balls that are slightly high or low. The pitch micro adjustment is shown in FIG. 5 as being about 7 degrees in either direction. However, as with the yaw micro adjustment, machine 10 may be set up to micro adjust either more or less than depicted In the event both yaw and pitch controls are provided in throwing machine 10, the operator is given maximum precise control in both yaw and pitch directions, with a simple and inexpensive mechanism that can be operated by one with little skill or experience to present the most realistic pitching machine experience possible.

Figure 7:
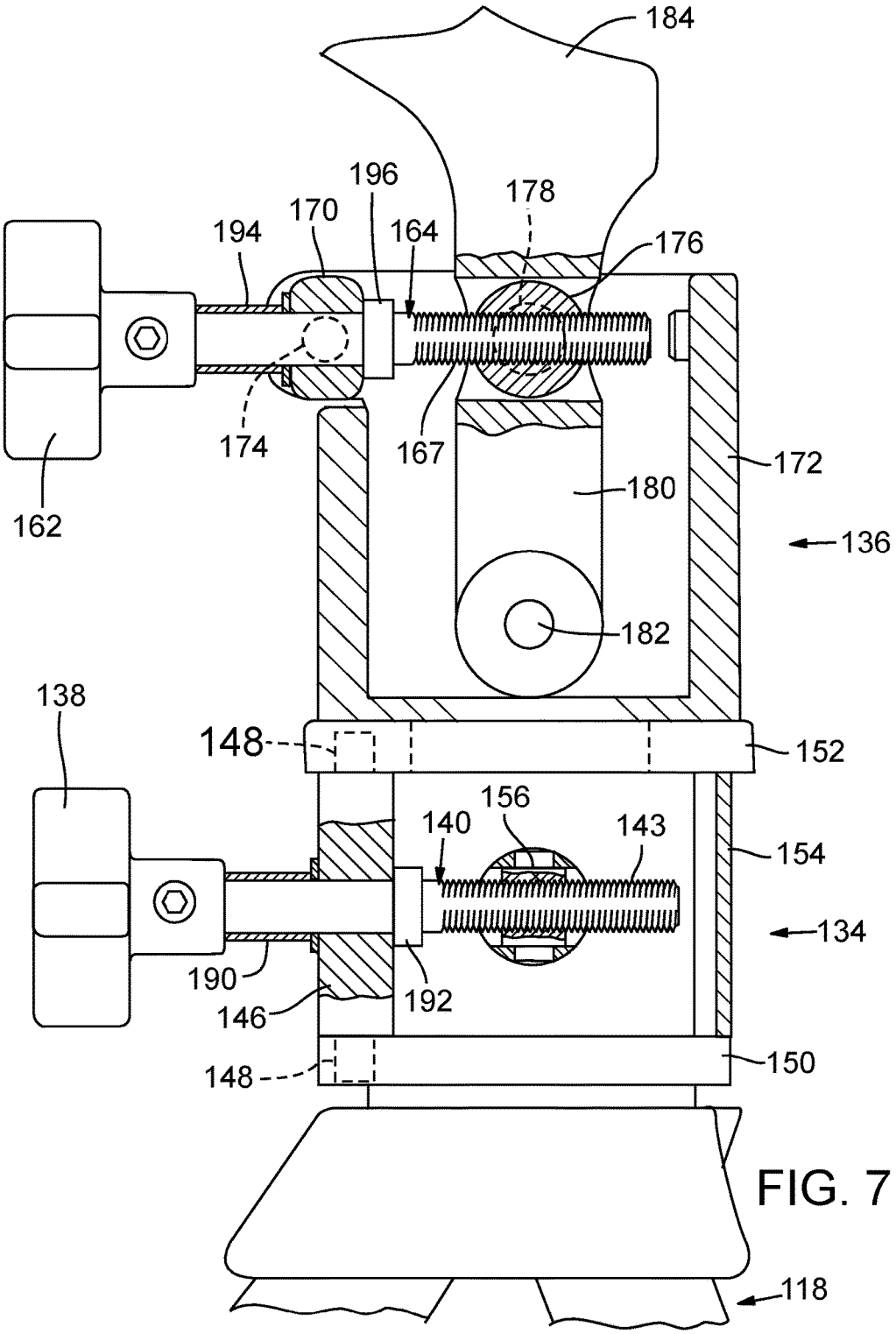
FIG. 7 is an alternate embodiment of the adjustment mechanism showing the axial position of the adjustment shaft fixed with respect to the body.

In an alternative embodiment depicted in FIG. 7, the pitching machine is indicated generally at 110. Because most of the components of this alternate embodiment are similar to those of pitching machine 10, corresponding components are indicated with similar part numbers except that they are in the 100 series. Thus, the horizontal or yaw micro adjustment is shown generally at 134, the vertical or pitch micro adjustment is shown generally at 136, the yaw knob is 138, the yaw micro adjustment shaft is 140, its threads are 143, the yaw micro adjustment shaft mounting post is 146, the yaw micro adjustment shaft mounting post pins are 148, the lower and upper frame plates are 150 and 152, respectively, the yaw yoke is 156, the pitch micro adjust knob is 162, the pitch micro adjustment shaft is 164, its threads are 167, the pitch micro adjust shaft mounting post is 170, the mounting pins are 174, the pitch housing is 172, the pitch yoke is 176, the pitch yoke mounting pin is 178, the pitch pivot arm is 180, the pitch pivot pin is 182, and the gooseneck is 184.

The difference between machine 110 and machine 10 is that instead of yaw micro adjust shaft 140 including a second set of threads such as those at 42, yaw micro adjust shaft 140 includes a sleeve 190 and bushing 192 fixed to the shaft that permit the shaft to rotate but fix the axial position of the shaft with respect to mounting post 146. Similarly, instead of pitch micro adjust shaft 164 including a second set of threads such as those at 66, pitch micro adjust shaft 164 includes a sleeve 194 and bushing 196 fixed to the shaft that permit the shaft to rotate but fix the axial position of the shaft with respect to mounting post 170.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A machine for throwing balls that can accurately adjust a vertical height or pitch and a lateral placement or yaw of balls being thrown, comprising:

a pitch housing;

a threaded pitch adjustment shaft rotatably mounted to the pitch housing;

a pitch yoke threadably mounted to the pitch adjustment shaft to travel with the pitch adjustment shaft as the pitch adjustment shaft is rotated, the pitch yoke being mounted to a rotary wheel mount for rotating at least one wheel to throw a ball toward an athlete;

a yaw housing fixed to the pitch housing;

a threaded yaw adjustment shaft rotatably mounted to the yaw housing;

a yaw yoke eccentrically mounted to the yaw housing and mounted to the yaw adjustment shaft to travel with the yaw adjustment shaft as the yaw adjustment shaft is rotated; and a stand to which the yaw housing is rotatably mounted, such that as the yaw adjustment shaft is rotated, the yaw housing rotates the pitch housing and the rotary wheel mounting with respect to the stand to adjust throws to a left direction or a right direction.

2. The machine of claim 1 wherein the yaw and pitch adjustment shafts each includes two sets of oppositely-directed threads, with a first set of threads that threadably mount the shafts to the yaw housing and pitch housing, respectively, and a second set of threads to which the yaw yoke and pitch yoke, respectively, are threadably mounted.

3. The machine of claim 1 wherein the yaw housing is substantially cylindrical and the stand includes a substantially cylindrical body, with one of the yaw housing or the body nesting inside the other of the yaw housing or the body to facilitate rotation between the yaw housing and the body.

4. The machine of claim 3 wherein the yaw housing and the pitch housing comprising one integral piece to which the yaw adjustment shaft and the pitch adjustment shaft are mounted.

5. A machine for throwing balls that can accurately adjust a vertical height or pitch and a lateral placement or yaw of balls being thrown, comprising:

a housing;

a threaded pitch adjustment shaft rotatably mounted to the housing;

a pitch yoke mounted to the pitch adjustment shaft to travel with the pitch adjustment shaft and with respect to the housing as the pitch adjustment shaft is rotated;

a pitch pivot arm pivotally mounted at a pivot point to the housing, the pitch yoke also being mounted to the pitch pivot arm, the pitch pivot arm being mounted to a rotary wheel mount for rotating at least one wheel to throw a ball toward an athlete;

a threaded yaw adjustment shaft rotatably mounted to the housing;

a stand including a body to which the housing is rotatably mounted; and a yaw yoke mounted to the body and to the yaw adjustment shaft to travel on the yaw adjustment shaft as the yaw adjustment shaft is rotated with respect to the housing, thereby adjusting the position of the housing and the rotary wheel mount with respect to the stand and the body.

6. The machine of claim 5 wherein the body and the housing comprise substantially cylindrical members having coincident axes.

7. The machine of claim 6 wherein at least a portion of the housing surrounds at least a portion of the body.

8. The machine of claim 5, wherein the housing includes a yaw portion and a pitch portion, the yaw portion substantially surrounds the body, and the pitch portion substantially surrounds the pivot point and a portion of the pitch pivot arm.

9. The machine of claim 8, wherein the yaw portion and the pitch portion of the housing are substantially cylindrical with coincident axes and the yaw portion is below the pitch portion of the housing.

10. The machine of claim 5 wherein the yaw adjustment shaft includes two sets of oppositely-directed threads, with a first set of threads that threadably mount the yaw adjustment shaft to the housing and a second set of threads to which the yaw yoke is threadably mounted.

11. The machine of claim 10 wherein the pitch adjustment shaft includes two sets of oppositely-directed threads, with a first set of threads that threadably mount the pitch adjustment shaft to the housing and a second set of threads to which the pitch yoke is threadably mounted.

12. The machine of claim 5 wherein the yaw yoke is eccentrically mounted to the body.

* * * * *